US005522106A

United States Patent [19]

Harrison et al.

[11] Patent Number: 5,522,106

[45] Date of Patent: Jun. 4, 1996

[54] SEAT CUSHION ASSEMBLY

[75] Inventors: Patrick N. Harrison, Aurora; Nenad B. Medjedovic, Downsview, both of Canada

[73] Assignee: Special Health Systems Ltd., Aurora, Canada

[21] Appl. No.: 344,659

[22] Filed: Nov. 18, 1994

Related U.S. Application Data

[63] Continuation of Ser. No. 151,665, Nov. 15, 1993.

[51] Int. Cl.[6] ..... B68G 5/00

[52] U.S. Cl. ..... 5/653; 297/452.25; 297/452.27

[58] Field of Search ..... 5/653, 654; 297/452.25, 297/452.26, 452.27

[56] References Cited

U.S. PATENT DOCUMENTS

| | | | |
|---|---|---|---|
| 3,264,382 | 8/1966 | Angell et al. | 264/46.4 |
| 3,987,507 | 10/1976 | Hall | 5/653 |
| 4,643,481 | 2/1987 | Saloff et al. | 297/452.25 |
| 4,682,818 | 7/1987 | Morell | 5/653 |
| 4,819,288 | 4/1989 | Lowthian | 297/452.27 |
| 4,930,171 | 6/1990 | Frantz | 5/654 |
| 5,018,790 | 5/1991 | Jay | 5/653 |
| 5,163,737 | 11/1992 | Navach et al. | 297/452.25 |
| 5,189,747 | 3/1993 | Mundy et al. | 5/653 |
| 5,294,181 | 3/1994 | Rose et al. | 297/452.27 |
| 5,395,162 | 3/1995 | Jay et al. | 297/452.25 |

*Primary Examiner*—F. Daniel Lopez
*Attorney, Agent, or Firm*—Rogers & Scott

[57] ABSTRACT

A seat cushion assembly has a lower layer of resilient shape-retaining material with an upper surface having a pair of adjacent parallel channel-shaped recesses extending rearwardly from a front end of the cushion assembly and shaped to conform to the undersides of the thighs of a sitting person. The upper surface also has a rear recess in a rearward and intermediate area positioned to be beneath the buttocks of the sitting person. An insert of relatively firm deformable material is located in the rear recess of the lower layer, and an upper layer of soft material covers the lower layer and the insert. The upper layer has channel-shaped recesses conforming with the channel-shaped recesses in the lower layer and a buttock-receiving recess over the insert. The insert serving to accommodate ischial tuberosities of the sitting person and prevents the ischial tuberosities from bottoming out through the cushion assembly. The insert also provides an even distribution of forces over these bony areas.

3 Claims, 1 Drawing Sheet

SEAT CUSHION ASSEMBLY

This application is a continuation of patent application Ser. No. 08/151,665 filed Nov. 15, 1993.

This invention relates to seat cushion assemblies.

It is known to provide seat cushions constructed from a variety of materials and/or components. However, there is still a need for a seat cushion assembly which provides comfort for persons who have to sit for a prolonged period of time, for example in wheelchairs.

It is therefore an object of the invention to provide an improved seat cushion assembly which is useful not only with wheelchairs but also for seating furniture such as chairs or couches.

According to the present invention, a seat cushion assembly has a lower layer of resilient shape-retaining material with an upper surface having a pair of adjacent parallel channel-shaped recesses extending rearwardly from a front end of the cushion assembly and shaped to conform to the undersides of the thighs of a sitting person, said upper surface also having a rear recess in a rearward and intermediate area positioned to be beneath the buttocks of a sitting person, an insert of relatively firm deformable material in the rear recess of the lower layer, and an upper layer of soft material covering the lower layer and the insert, with said upper layer having a channel-shaped recess conforming with the channel-shaped recesses in the lower layer and a buttock-receiving recess over the insert, said insert serving to accommodate ischial tuberosities of a sitting person and preventing the ischial tuberosities from bottoming out through the cushion assembly.

The lower layer may be of polyurethane foam, the insert may be of relatively firm visco elastic foam and the upper layer may be of soft visco elastic foam. The upper layer may be molded onto the lower layer with the insert therebetween.

One embodiment of the invention will now be described, by way of example, with reference to the accompanying drawings, of which:

Figure 3:
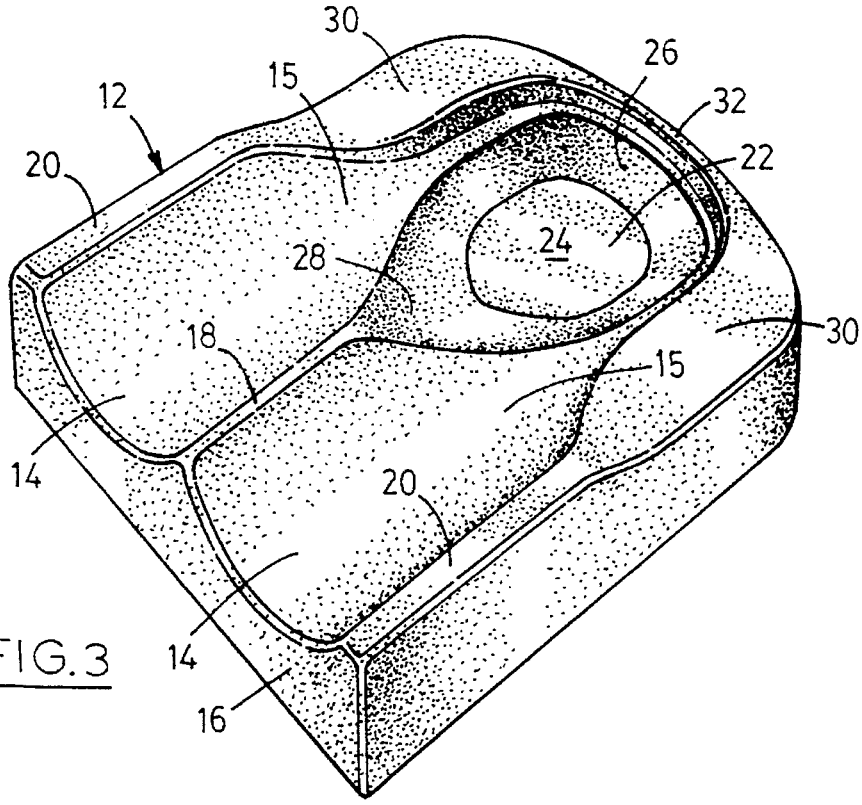
FIG. 3 is a similar view of the lower layer thereof.

Referring to the drawings, a seat cushion assembly has a molded lower layer 12 of resilient shape-retaining polyurethane foam. As shown in FIG. 3, the upper surface of the lower layer 12 has a pair of adjacent parallel channel-shaped recesses 14 each of semi-eliptical section extending rearwardly from the front end 16 and shaped to conform to the undersides of the thighs of a sitting person. The channel-shaped recesses 14 are separated by a central pommel 18 and the laterally-outer sides 20 of the recesses 16 form lateral leg supports. Also, the channel-shaped recesses 14 have tapering recess portions 15 extending rearwardly therefrom.

The upper surface of the lower layer 12 also has a rear recess 22 in an area rearwardly of and intermediated the channel-shaped recesses 14 and positioned to be beneath the buttocks of a sitting person. The rear recess 12 has a flat bottom surface 24 with an upwardly and outwardly inclined side wall 26, the forward portion of which tapers to form a urethral depression 28. The tapering means portions 15 which extend rearwardly from the channel-shaped recesses 14 extend on opposite sides of the forwardly tapering depression 28. Laterally outwardly of the rear recess 22, the upper surface of the lower layer 12 has flat surface portions 30 each forming a trochanteric shelf. Rearwardly of the rear recess 22, the upper surface of the lower layer 12 has a flat surface portion 32 which provides posterior pelvic support.

Figure 2:
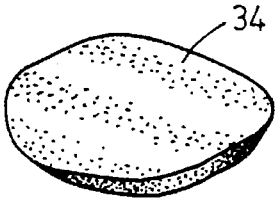
FIG. 2 is a similar view of the insert thereof.

Referring now to FIG. 2, the seat cushion assembly also includes a relatively firm deformable insert 34 with flat upper and lower surfaces and shaped to fit into the rear recess 22 in the lower layer 12. The insert 34 is a molding of relatively firm visco elastic foam and serves to accommodate ischial tuberosities of a sitting person as will be described in more detail later.

The lower layer 12 and insert 34 are molded separately, and the insert 34 is then placed in rear recess 22 of the lower layer 12. If desired, the insert 34 may be secured in recess 22 by means of a suitable adhesive. The lower layer 12 and positioned insert 34 are then placed in a further mold into which a relatively soft visco elastic foam is injected to form an upper layer 36 covering the lower layer 12 and the insert 34.

Figure 1:
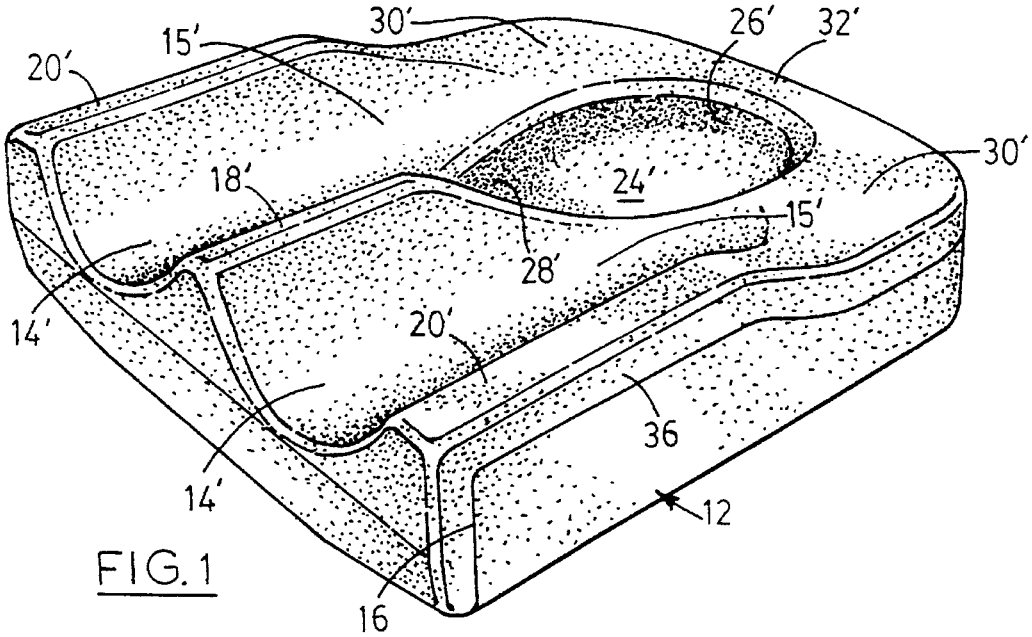
FIG. 1 is a perspective view of a seat cushion, assembly.

As shown in FIG. 1, the upper layer 36 conforms with the shape of the upper surfaces of the lower layer 12 and insert 34, thereby providing thigh-receiving channels 14', with tapering rearwardly extending recess portions 15', pommel 18', lateral channel support walls 20', ischial recess 22', with central ischial surface 24', side wall 26'and forwardly tapering urethral depression 28', trochanteric shelves 30', and posterior pelvic support 32'. As also shown, the upper layer 36 extends forwardly and downwardly over the front end 16 of the lower layer 12.

The disadvantages of the invention will be readily apparent to a person skilled in the art from the foregoing description of the preferred embodiment. In particular, the insert 34 accommodates the ischial tuberosities of a sitting person and provides uniform pressure distribution around such bony prominences as well as preventing them from bottoming out through the cushion assembly. Other materials can of course be used for the various cushion components. For example, the insert may be a sealed liquid-containing pouch. The finished product will be provided with a suitable covering material.

As previously mentioned, the seat cushion assembly is especially useful for providing sitting comfort when a person has to sit for a prolonged period of time, such as in a wheelchair. However, as will also be readily apparent from the foregoing description, the invention can also be utilized in seating furniture such as chairs or couches.

Other embodiments will also be readily apparent to a person skilled in the art, the scope of the invention being defined in the appended claims.

We claim:

1. A seat cushion assembly comprising:

A lower layer of resilient shape-retaining material with an upper surface having a pair of adjacent parallel channel-shaped recesses extending rearwardly from a front end of the cushion assembly and shaped to conform to undersides of thighs of a sitting person, said upper surface also having a rear recess in a rearward and intermediate area positioned to be beneath buttocks of the sitting person, said rear recess having a tapering forward portion tapering in width in a forward direction and said pair of adjacent parallel channel-shaped recesses having tapering recess portions extending rearwardly therefrom and tapering in width in a rearward direction on opposite sides of the tapering portion of the rear recess, an insert of relatively firm deformable material in the rear recess of the lower layer, and an upper layer of soft material covering and conforming with the shape of the upper surfaces of the lower layer and the insert, with said upper layer thus having recesses conforming with the channel-shaped recesses and tapering recess portions extending rearwardly in the lower layer and a buttock-receiving recess over the insert, said insert serving to accommodate ischial tuberosities of the sitting person and prevent the ischial tuberosities from bottoming out through the cushion assembly.

2. A seat cushion assembly according to claim 1 wherein the lower layer is of polyurethane foam, the insert is of relatively firm visco elastic foam and the upper layer is of soft visco elastic foam.

3. A seat cushion assembly according to claim 1 wherein the upper layer is molded onto the lower layer with the insert therebetween.

* * * * *